US011390424B2

(12) United States Patent
Knob et al.

(10) Patent No.: US 11,390,424 B2
(45) Date of Patent: Jul. 19, 2022

(54) COLLAPSIBLE MULTI-TRAY PACKAGING WITH FLEXIBLE INSERT CELLS FOR TRANSPORT OF GOODS

(71) Applicant: PPO GROUP CZ, s.r.o., Znojmo (CZ)

(72) Inventors: Josef Knob, Novy Saldorf (CZ); Andrej Herenyi, Znojmo (CZ)

( * ) Notice: Subject to any disclaimer, the term of this patent is extended or adjusted under 35 U.S.C. 154(b) by 175 days.

(21) Appl. No.: 16/696,057

(22) Filed: Nov. 26, 2019

(65) Prior Publication Data

US 2020/0407114 A1 Dec. 31, 2020

(30) Foreign Application Priority Data

Jun. 25, 2019 (CZ) ..... CZ2019-36343

(51) Int. Cl.
*B65D 25/08* (2006.01)
*B65D 21/08* (2006.01)
*B65D 77/04* (2006.01)

(52) U.S. Cl.
CPC ..... *B65D 25/08* (2013.01); *B65D 21/086* (2013.01); *B65D 77/0466* (2013.01)

(58) Field of Classification Search
CPC .. B65D 25/08; B65D 21/086; B65D 77/0466; B65D 25/04; B65D 2519/0082; B65D 2519/009; B65D 2519/00656; B65D 2519/00587; B65D 2519/00174; B65D 2519/00338; B65D 19/06; B65D 19/38; B65D 25/06; B65D 88/54; B65D 19/36; B65D 85/00
See application file for complete search history.

(56) References Cited

U.S. PATENT DOCUMENTS 3,091,195 A * 5/1963 Kenyon ..... B65D 19/06 108/53.5
3,998,169 A * 12/1976 Koch ..... B65D 19/16 108/53.5
4,339,047 A * 7/1982 Johansson ..... B65D 19/12 206/509
4,630,746 A * 12/1986 Fortenberry ..... B65D 19/18 220/1.5

(Continued)

FOREIGN PATENT DOCUMENTS

CZ 27579 U1 12/2014
CZ 29811 U1 10/2016

*Primary Examiner* — Kareen K Thomas
(74) *Attorney, Agent, or Firm* — Rumit Ranjit Kanakia

(57) ABSTRACT

A collapsible multi-tray packaging with flexible insert cells for transport of goods, includes collapsible frame structure, with opposing inwardly foldable shorter sides and opposing inwardly foldable longer sides, with at least two trays of flexible insert cells, the flexible insert cells are in each tray movably mounted in the inner groove of horizontal guides using sliding elements. The horizontal guides are interconnected with a flexible material between individual trays. On the two outer faces of the opposing shorted sides, there are vertical C-shaped guides mounted. In the vertical guides, sliding couplings are movably mounted, these couplings being firmly attached to the outer face of the horizontal guides. To the outer face of the horizontal guide of the first top tray there are suspension hooks attached, which are suspended with their curved part from the top face of the opposing shorter sides of the frame structure.

1 Claim, 5 Drawing Sheets

(56) References Cited

Figure 1:
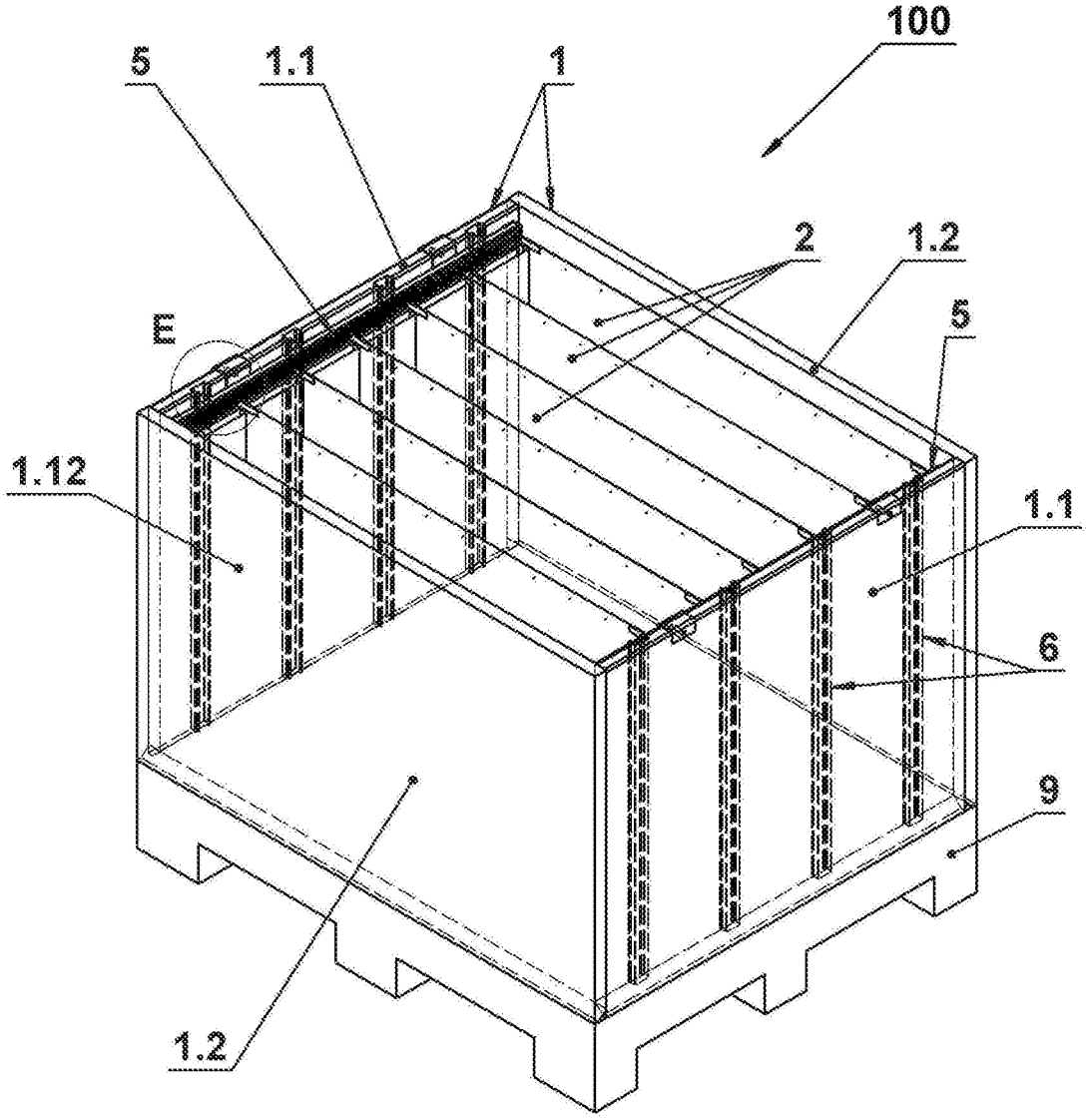

U.S. PATENT DOCUMENTS 4,715,508 A * 12/1987 Schurch ..... B65D 19/12
220/1.5
5,555,980 A * 9/1996 Johnston ..... B65D 19/18
206/386
5,597,084 A * 1/1997 Parasin ..... B65D 11/1873
206/600
5,680,948 A * 10/1997 Schmidt ..... B65D 19/06
220/7
5,794,542 A * 8/1998 Besaw ..... B65D 19/0012
108/51.3
5,845,799 A * 12/1998 Deaton ..... B65D 77/0466
220/1.5
5,918,755 A * 7/1999 Warn ..... B65D 19/16
220/4.09
6,164,476 A * 12/2000 Rene ..... B65D 19/12
220/4.31

* cited by examiner

COLLAPSIBLE MULTI-TRAY PACKAGING WITH FLEXIBLE INSERT CELLS FOR TRANSPORT OF GOODS

TECHNICAL FIELD

The invention is related to a collapsible multi-tray packaging with flexible insert cells for transport of goods.

BACKGROUND ART

Known packagings for transport of goods with movable insert cells (so-called Sliding Waves) and the like allow access to individual trays, on which the transported goods are placed, without dismantling or removing other trays placed under or above the tray from which the goods are taken or deposited. The insert cells are formed from a flexible plastic material or a non-woven textile material. The insert cells are tensioned in a horizontal guide which is mounted on the opposite sides of the packaging. A horizontal guide for tensioning the insert cells is connected to the packaging by means of a fastener. Even if this connection of the horizontal guide can be dismantled, it cannot be moved or adjusted without partial dismantling, so the connection has the characteristics of a fixed non-detachable connection. In this way, all individual trays with insert cells are fixed, which may include regular and irregular fixed spacing. Known packagings for transport of goods can be made both rigid and collapsible, wherein the collapsible packagings save space when folded. The outer structure of the collapsible packaging may be metal, wood, or plastic, or a combination of said materials. During use of a collapsible packaging—folding it, due to the rigid connection of the horizontal guide to the outer shell of the packaging strong tension and pull occur in the individual textile or plastic portions of the insert cells, which may damage the integrity of the insert cells. Another disadvantage is the lengthy assembly and the resulting complicated and difficult handling when folding or unfolding the entire collapsible packaging for transporting goods. The above-mentioned disadvantages are partially eliminated in CZ Utility Design No. 27579, which discloses a collapsible packaging solution which consists of a collapsible outer packaging inside which one or more stacked trays of flexible insert cells which are supported on struts, are stored. These struts are guided in a horizontal guide, wherein the horizontal guides are formed on suspension elements. The suspension elements contain a tentrail profile in which flexible material forming the insert cells is mounted. The disadvantage of this solution is the use of struts, which cannot be used for some types of goods. From CZ Utility Design No. 29811, a solution for a packaging for transport of goods is known, comprising at least one column in which at least two trays of flexibly collapsible insert cells are stacked vertically, which can be folded to one side of the packaging. However, the design for vertical stacking multiple trays of insert cells is complex.

DISCLOSURE OF INVENTION

The disadvantages of the known packagings for transport of goods are largely eliminated by the collapsible multi-tray packaging with flexible insert cells according to the invention. The collapsible multi-tray packaging comprises a collapsible frame structure that includes opposing inwardly foldable shorter sides and opposing inwardly foldable longer sides. The collapsible multi-tray packaging comprises at least two trays of flexible insert cells, wherein the flexible insert cells in each tray are glidingly mounted in the inner groove of the horizontal guides using sliding elements. The horizontal guides are interconnected by flexible material between the trays. The summary of the invention consists in that two C-shaped vertical guides are mounted on the two outer faces of the opposite shorter sides of the frame structure, wherein sliding couplings are glidingly mounted in the vertical guides. These sliding couplings are firmly fixed to the outer face of the horizontal guides. Suspension hooks are attached to the outer face of the horizontal guide of the first upper deck, which are suspended with their curved section from the top face of the opposite shorter sides of the frame structure.

The advantages of the invention/technical solution may be summarized as follows:

elimination of complex mounting of individual trays to exact positions using a large amount of fasteners eliminating the tension in the insert cells during the folding or unfolding process of the outer shell of the packaging, as the sliding elements between the horizontal guide and the vertical guide of the outer shell allow the insert cells to move to a different position. When unfolded into a functional state, the insert cells in the horizontal guide slide again into the desired position, which is guaranteed by the flexible and elastic interconnection of the individual trays.

eliminating the tensions results in a reduction in the physical load of the operator, who has to fold or unfold the outer shell of the packaging, hence handling is less strenuous and more ergonomic.

AN OVERVIEW OF THE DRAWINGS

Figure 2:
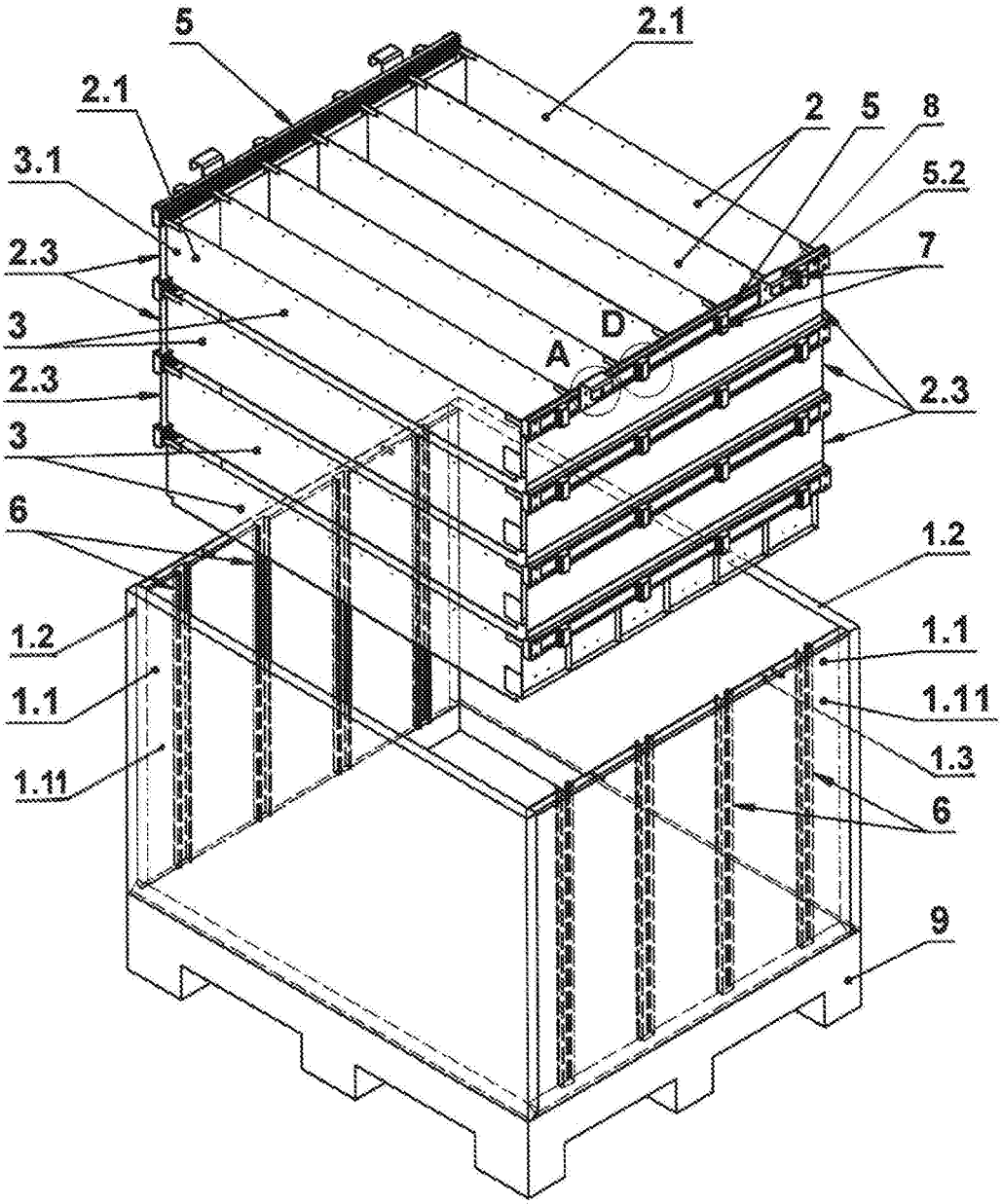
Figure 3:
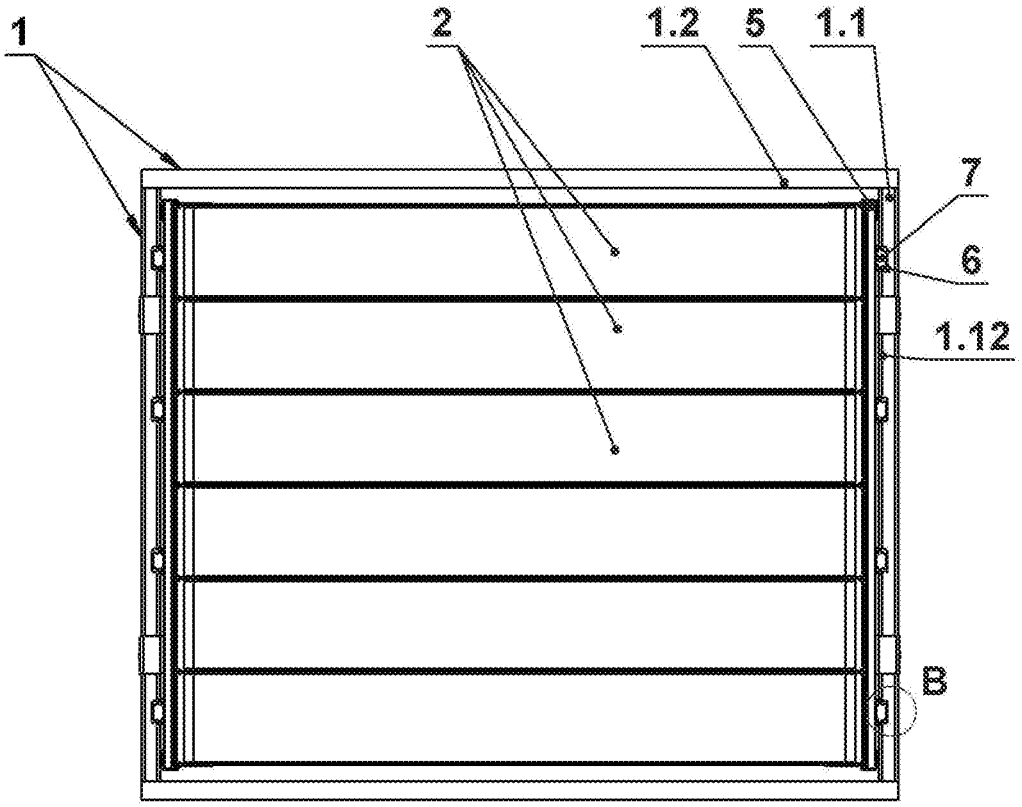

The invention/technical solution is explained in detail on the attached drawings which illustrate:

FIG. 1—shows assembled collapsible multi-tray packaging for transport of goods FIG. 2—shows view of unfolded packaging of FIG. 1 with inserted flexible insert cells FIG. 3—shows top view of the packaging of FIG. 1

Figure 4:
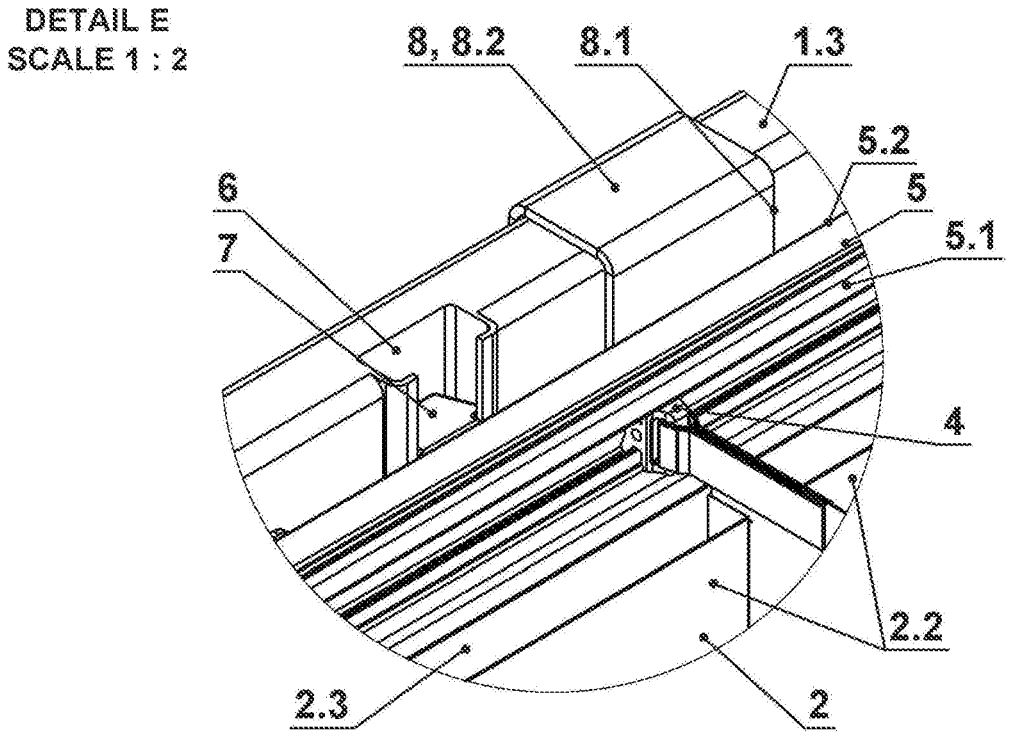
Figure 5:
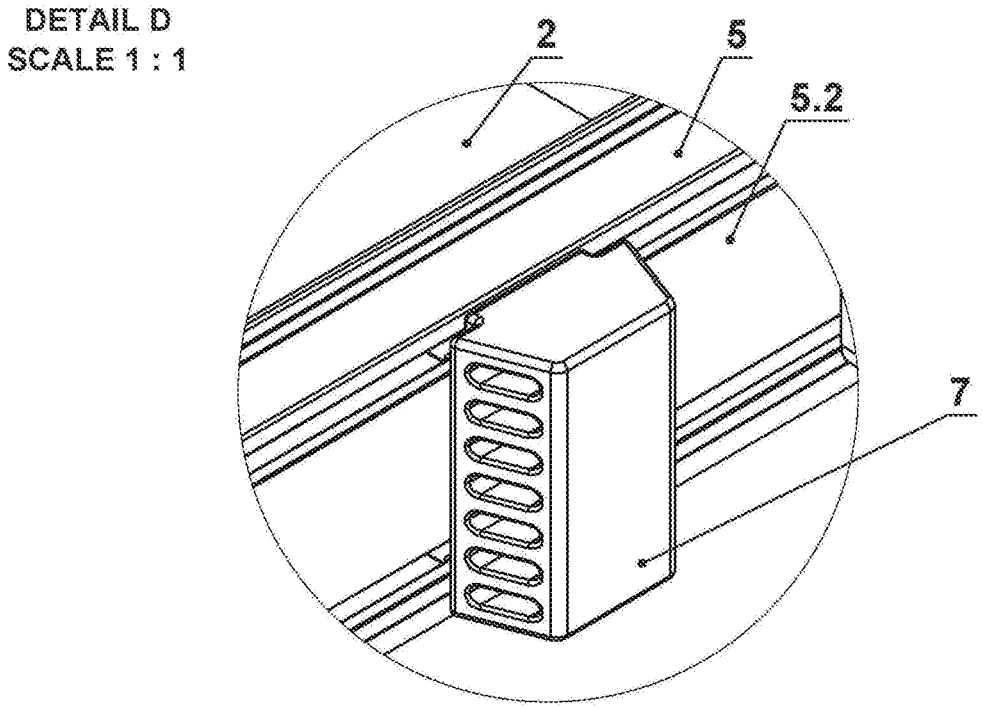
Figure 6:
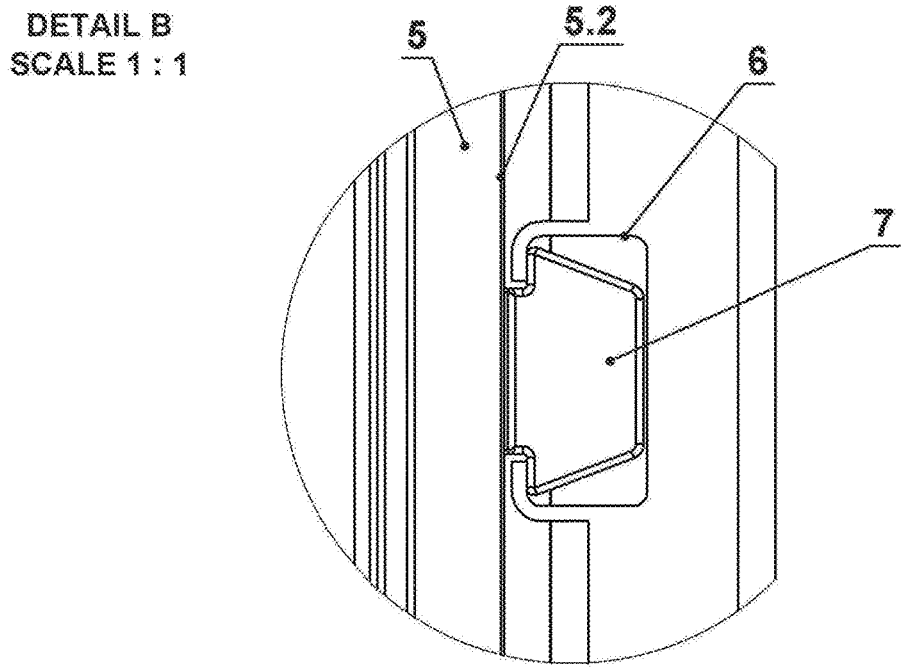
Figure 7:
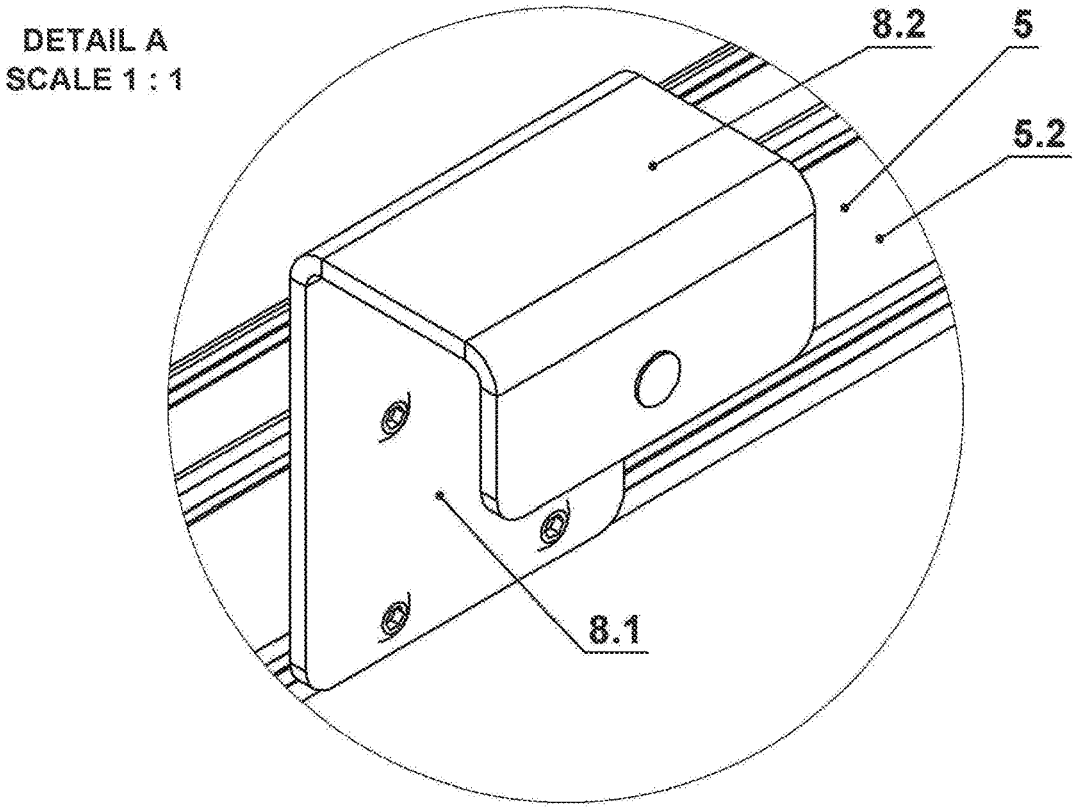

FIG. 4—shows detail "E" of FIG. 1—mounting of the insert cells in the horizontal guide, attachment of the sliding coupling in the vertical C-shaped guide to the outer face of the frame structure and of the suspension hook to the top face of the collapsible frame structure FIG. 5—shows detail "D" of FIG. 1—sliding coupling mounted on the outer face of the frame structure FIG. 6—shows detail "B" of FIG. 3—C-shaped sliding connection between the horizontal guide and vertical guide on the outer face of the frame structure FIG. 7—shows detail "A" of FIG. 2—attachment of the upper tray of the horizontal guide of the flexible insert cells by the suspension hook to the upper face of the collapsible frame structure

EXAMPLES OF INVENTION EMBODIMENTS

The FIGS. 1 to 3 illustrate a collapsible multi-tray packaging 100 (hereinafter "packaging" 100) in folded condition (FIG. 3) and in the unfolded condition (FIG. 2). The packaging 100 comprises a collapsible frame structure 1, containing inside at least two vertically stacked trays 3 of insert cells 2; the illustrated example embodiment has four vertically stacked trays 3 of insert cells 2. The insert cells 2 are made of a soft flexible material, for example woven textiles, non-woven textiles, canvas, etc. The collapsible frame structure 1 is formed for example from a rigid plastic and is placed on a palette 9. The palette 9 and the collapsible frame structure 1 are connected with mechanical demountable or non-demountable joints, for example pins locked with split pins etc. The collapsible frame structure 1 with a rectangular base consists of two shorter sides 1.1 and two longer sides 1.2, while these sides 1.1 and 1.2 can be folded inwards as described below. The shorter sides 1.1 and longer sides 1.2 are fixed in a vertical position with commonly available mechanical stops or other commonly available methods proven in technical practice. On the outer faces 1.11 of the shorter sides 1.1, the vertical C-shaped guides 6 are dismantably attached, for example using screws, and extend along the entire vertical lengths of the shorter sides 1.1. The vertical guides 6 are formed from metal or, alternatively, from plastic. The number of vertical guides 6 attached on the outer faces 1.11 of the shorter sides 1.1 of the frame structure 1 is selected according to the dimensions of packaging 100, for the example given the number of vertical guides 6 is four. The packaging 100 may be closed with a lid (not shown).

As mentioned above, in the example embodiment the packaging 100 is assembled from four trays 3, while on each tray 3 there are six insert cells 2 into which the transported goods are inserted. The outer vertical faces 2.1 of the first and the last insert cell 2, and side vertical faces 2.2 of two adjacent insert cells 2 are on each tray 3 fixed into sliding elements 4, wherein these sliding elements 4 are movably mounted in the inner groove 5.1 of the horizontal guides 5, which means that when one insert cell 2 moves, the adjacent insert cell moves as well and gradually the other insert cells 2 will move, as soon as the adjacent insert cell 2 is stretched or wrapped towards the adjacent insert cell (FIG. 4). This movement of the insert cells 2 occurs on each of the trays 3 independently of the movement of the insert cells 2 on another tray 3. The horizontal guides 5 are in vertical position between individual trays 3, interconnected with a flexible material 2.3 guided in the grooves (not shown) of the horizontal guide 5, wherein the movement of the flexible material 2.3 is not linked to the movement of the insert cells 2 in individual trays 3.

To enable folding of shorter sides 1.1 of the frame structure 1 with the attached insert cells 2 inwards of the packaging 100, it is necessary to interconnect the horizontal guides 5 with the shorter sides 1.1 of the frame structure 1. This interconnection is implemented using sliding couplings 7 (FIG. 2, 4, 5). The sliding couplings 7 are on each tray 3 firmly attached to the outer face 5.2 of the horizontal guides 5 with fasteners and at the same time glidingly mounted in the vertical C-shaped guides 6. A possible design of the shape of the sliding couplings 7 is shown in FIG. 5. In order to fold the shorter sides 1.1 of the frame structure 1 with insert cells 2 fixed inside the packaging 100, it is further necessary to firmly connect the horizontal guides 5 of the first top tray 3.1 of the insert cells 2 with the outer face 1.11 of the shorter sides 1.1 of the frame structure 1, which is done using the suspension hook 8, the straight part 8.1 of which is fixed using fasteners to the outer face 5.2 of the horizontal guide 5, and with the curved part 8.2 it is suspended from the top face 1.3 of the shorter side 1.1 of the frame structure 1.

The procedure for folding of the package: one (the first) shorter side 1.1 of the collapsible frame structure 1 with attached insert cells 2 is released from its position. Subsequently, the first shorter side 1.1 folds inward of the collapsible frame structure 1, and there is also one half of the insert cells 2 folded (wrapped) beneath it. The operator then releases the second opposing shorter side 1.1 from the vertical position, which, after folding inwards of the collapsible frame structure 1, shall rest on the already folded first shorter side 1.1, wherein there is the other half of the insert cells 2 folded (wrapped) beneath it. The insert cells 2, thanks to the sliding couplings 7 moving in the vertical C-shaped guide 6, will, during folding of the shorter sides 1.1, fold between the folded shorter sides 1.1 without increased tension. On the already folded shorter sides 1.1 and insert cells 2 both longer sides 1.2 of the collapsible frame structure 1 are folded. The folding order of the short sides 1.1 does not matter, since the folding works regardless of the order. The same applies to folding long sides 1.2. The unfolding is done in reverse order. For outer packagings that do not contain longer sides 1.2, folding is simplified to folding only the shorter sides 1.1 with insert cells. The folding procedure is not affected by any covering. The principle of folding and subsequent distribution of the shorter sides 1.1 and the longer sides 1.2 remains the same.

LIST OF REFERENCES

100 collapsible multi-tray packaging
1 collapsible frame structure
1.1 shorter side of the frame structure
1.11 outer face of the shorter side of the frame structure
1.12 inner face of the shorter side of the frame structure
1.2 longer side of the frame structure
1.3 top face
2 insert cells
2.1 outer vertical sides of the insert cells
2.2 lateral vertical sides of adjacent insert cells
2.3 flexible material
3 tray
3.1 top tray
4 sliding elements
5 horizontal guides
5.1 inner groove in the horizontal guide
5.2 outer face of the horizontal guide
6 vertical C-shaped guides
7 sliding couplings
8 suspension hook
8.1 straight part
8.2 curved part of the suspension hook
9 palette

The invention claimed is:

1. A collapsible multi-tray packaging with flexible insert cells for transport of goods, comprising collapsible frame structure, which comprises opposing inwardly foldable shorter sides and opposing inwardly foldable longer sides, further comprising at least two trays of flexible insert cells, wherein the flexible insert cells are in each tray movably mounted in an inner groove of horizontal guides sing sliding elements, and wherein the horizontal guides are interconnected with a flexible material between individual trays, wherein movement of the flexible material is not linked to the movement of the insert cells in individual trays wherein on two outer faces of the opposing shorted sides of the collapsible frame structure there are vertical C-shaped guides mounted, wherein in the vertical guides sliding couplings are movably mounted, these sliding couplings being firmly attached to an outer face of the horizontal guides, and wherein to the outer face of the horizontal guide of a first top tray there are suspension hooks attached, which are suspended with their curved part from a top face of the opposing shorter sides of the frame structure.

* * * * *